United States Patent [19]

Parquet et al.

[11] Patent Number: 4,515,520

[45] Date of Patent: May 7, 1985

[54] STABILIZER ASSEMBLY

[75] Inventors: Donald J. Parquet, Burlington; Thomas R. Brown, Yarmouth; Eldon R. Edwards, Burlington, all of Iowa

[73] Assignee: J. I. Case Company, Racine, Wis.

[21] Appl. No.: 417,328

[22] Filed: Sep. 13, 1982

[51] Int. Cl.[3] ..... E02F 9/00

[52] U.S. Cl. ..... 414/718; 212/189; 280/765.1

[58] Field of Search ..... 414/694, 718; 254/423–427; 280/763–766; 212/189; 180/199

[56] References Cited

U.S. PATENT DOCUMENTS

| | | | |
|---|---|---|---|
| 3,843,154 | 10/1974 | Thompson | 280/766.1 |
| 4,026,428 | 5/1977 | Shumaker | 414/694 |
| 4,049,070 | 9/1977 | Soyland | 414/694 X |
| 4,080,080 | 3/1978 | Cisler | 403/378 X |

*Primary Examiner*—Robert J. Spar

*Assistant Examiner*—Donald W. Underwood

*Attorney, Agent, or Firm*—Dressler, Goldsmith, Shore, Sutker & Milnamow

[57] ABSTRACT

A stabilizer assembly for laterally supporting a construction vehicle of the type having a material handling implement. The preferred embodiments of the stabilizer assembly permit selective positioning of the outboard ends of the stabilizer arms over a wide range of positions from a position immediately adjacent the vehicle wheels and near the longitudinal center line of the vehicle frame to a position substantially outside of the wheels and farther from the longitudinal center line of the vehicle frame. The inboard ends of the stabilizer arms are pivotally secured to a stabilizer anchor which is transversely slidable relative to the vehicle frame on either side of the center line thereof. Various means are disclosed for positioning of the stabilizer anchor relative to the vehicle frame and for retaining the stabilizer anchor in such position.

4 Claims, 11 Drawing Figures

16
10
18
32
22
20
30
50
42
48
46
2.
2.
40
38
34
14
40
2
26
24

52
54
54
26
57
44
26
50
42
34
56
62
64
14
46
48
38
36
40
61
66
58
66
61
40

54
54
52
50
57
44
42
26
14
26
34
62
56
62
48
64
46
40
40
38
66
58
61
66
36

26
54
54
26
57
50
44
42
34
52
62
56
62
14
64
64
46
38
36
40
48
58
40
60
61
66
66
61

16
26'
26'
V
V
54'
54'
52'
50'
34'
57'
44'
42'
62'
62'
68
48'
64'
64'
46'
56'
14'
40'
66'
61'
66'
40'
38'
36'

26'
26'
V
V
54'
54'
52'
57'
50'
44'
34'
62'
42'
48'
62'
64'
56'
46'
14'
40'
68
40'
38'
66'
61'
61'
66'
36'

54"
V
V
54"
26"
26"
52"
57"
50"
14"
34"
44"
42"
70
8.
48"
46"
76
40"
40"
38"
71
8.
36"
82
84
92
94
90
96
98
81
88
86

76
74
70
72
71
80
78
84

54"
V
V
54"
26"
52"
57"
50"
26"
44"
14"
34"
42"
48"
70
46"
40"
40"
71
76
36"
38"
94
82
84
96
98
92
90
81
88
86

STABILIZER ASSEMBLY

BACKGROUND OF THE INVENTION

This invention relates to construction vehicles of the type having a material handling implement, and more particularly, to an improved stabilizer arm assembly for laterally supporting the vehicle and raising the wheels of the vehicle off the ground during operation of the material handling implement.

Many types of construction vehicles have stabilizer arms, or outriggers, which extend downwardly and outwardly from the frame sides during operation of their material handling implements, to engage the ground to laterally support the vehicle against tipping, and to anchor the vehicle to the ground by raising the wheels at the end of the vehicle having the material handling implement off the ground. For example, in a vehicle having a material handling implement, such as a backhoe, operatively connected to the rear end of the vehicle, a stabilizer arm is positioned generally adjacent and rearwardly of each of the rear wheels. It has also been found advantageous under some working conditions to mount stabilizer arms at the front end of the vehicle. U.S. Pat. Nos. 3,376,984; 3,951,281; 3,955,695; 4,026,428 and 4,286,803 disclose some typical arrangements of stabilizer arms.

A stabilizer arm typically has one end pivotally connected to the frame about a fixed stabilizer pivot point for movement between a ground engaging support position, extending laterally outward of the wheel, and a generally upright transport or storage position. To move the stabilizer arm between its support and transport positions and to apply a downward force on the stabilizer arm when in the support position to lift the vehicle off the ground, various power sources can be used. A common power source used in construction vehicles is a fluid ram, such as a hydraulic cylinder and piston rod assembly. Usually, one end of the fluid ram is pivotally mounted to the frame of the vehicle about a fixed pivot axis and the other end operatively connected to the stabilizer arm.

The typical stabilizer arm when in its support position extends laterally outward of the longitudinal center line of the vehicle frame by a fixed distance. In most instances this distance is selected to provide adequate stability for the vehicle under most operating conditions. However, under certain operating conditions it has been found to be desirable to either increase or decrease the distance which the stabilizer arm extends outward of such longitudinal center line. For example, when the vehicle is working near an obstruction, such as a roadway or building, it is necessary to position the end of the stabilizer arm close to the wheel and nearer to such longitudinal center line and when the vehicle is operating on a hillside, or the material handling implement is sideshifted, it is desirable to position the end of the stabilizer arm farther from the wheel and the longitudinal center line than is possible with typical stabilizer arms.

It is therefore desirable to provide a stabilizer assembly which permits the selective positioning of the end of the stabilizer arm relative to the wheel and longitudinal center line of the vehicle frame. One such assembly is disclosed in U.S. Pat. No. 3,550,795. In this assembly the inboard end of the stabilizer arm is pinned to the frame in one of two preselected positions. In order to reposition the outboard end of the stabilizer arm it is necessary that the operator manually repin the inboard end of the stabilizer arm. Further, this assembly only permits the positioning of the outboard end of the stabilizer arm in one of two positions. Under certain operating conditions it is desirable to precisely position the outboard end of the stabilizer arm in a specific relationship to the vehicle wheel.

SUMMARY OF THE INVENTION

In accordance with the preferred embodiments of the present invention an improved stabilizer assembly is provided which permits selective positioning of the outboard ends of the stabilizer arms over a wide range of positions from a position immediately adjacent the vehicle wheels and nearer the longitudinal center line of the vehicle frame to a position substantially outside of the wheels and farther from the longitudinal center line of the vehicle frame. In all of the preferred embodiments the inboard ends of the stabilizer arms are pivotally secured to a stabilizer anchor which is transversely slidable relative to the vehicle frame. Various means are contemplated for positioning of the stabilizer anchor relative to the vehicle frame and for retaining the stabilizer anchor in such position.

In accordance with a first preferred embodiment of the invention, the inboard ends of the stabilizer arms are pivotally secured to separate stabilizer anchors which are slidably mounted to the vehicle frame so as to permit selective transverse movement thereof on either side of the longitudinal center axis of the vehicle frame and thereby position the outboard ends of the stabilizer arms nearer and farther from the longitudinal center line of the vehicle frame. The outboard ends of the stabilizer arms are raised and lowered by hydraulic stabilizer cylinders which extend between the stabilizer arms and the frame. Retaining means are provided to selectively secure the stabilizer anchor to the vehicle frame in a fixed relationship.

In accordance with second, third and fourth preferred embodiments of the invention, the inboard ends of the stabilizer arms are pivotally secured to a common stabilizer anchor which is slidably mounted to the vehicle frame so as to permit selective transverse movement thereof on either side of the longitudinal center line of the vehicle frame and thereby position the outboard end of one of the stabilizer arms nearer the longitudinal center line of the vehicle frame and the outboard end of the other stabilizer arm farther from such longitudinal center line. In all of these embodiments the outboard ends of the stabilizer arms are raised and lowered by stabilizer cylinders as in the first embodiment. In the second embodiment, the stabilizer anchor is transversely slidable relative to the vehicle frame and the vehicle frame is moved relative to the stabilizer anchor by use of the material handling implement while the rear wheels are raised above the ground by the stabilizer assembly. In the third embodiment, the stabilizer anchor is transversely slidable relative to the vehicle frame and the stabilizer cylinders are used to move the stabilizer anchor relative to the vehicle frame while the wheels and stabilizers are on the ground. The stabilizer anchor is slidable on a rail member secured to the vehicle frame and a hydraulic piston clamp associated with the stabilizer anchor selectively secures the stabilizer anchor to the frame. The fourth embodiment is similar to the second embodiment except that the stabilizer anchor is moved relative to the vehicle frame while the stabilizer arms are in their raised positions above the ground by use of the stabilizer cylinders.

In all of the preferred embodiments of the invention, the movement of the stabilizer anchor relative to the longitudinal center line of the vehicle frame is effective to selectively position the outboard ends of the stabilizer arms nearer or farther from the longitudinal center line of the vehicle frame. In so doing, the vehicle may be operated in a safe and reliable manner under a wide variety of operating conditions.

Other advantages and features of the present invention will be apparent from the following detailed description of the preferred embodiments of the invention, from the claims and from the accompanying drawings in which each and every detail shown is fully and completely disclosed as a part of this specification in which like numerals refer to like parts.

DESCRIPTION OF THE PREFERRED EMBODIMENTS

Figure 1:
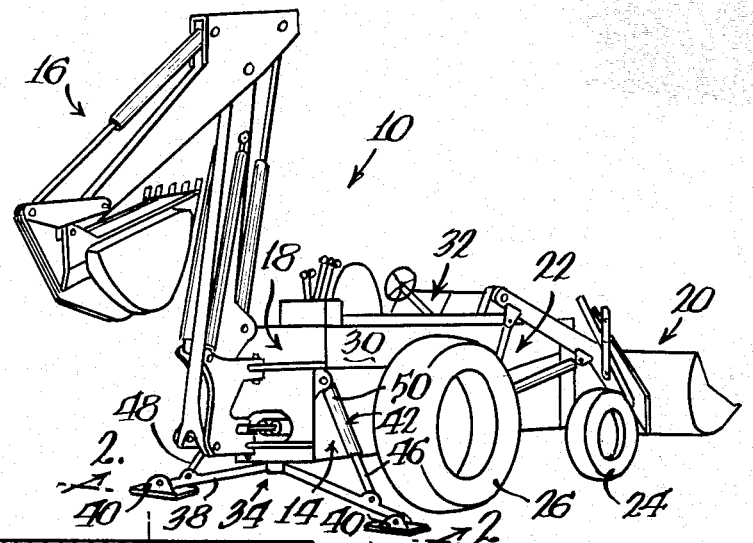
FIG. 1 is a perspective view of a wheeled construction vehicle having a stabilizer assembly constructed in accordance with principles of the present invention.

While this invention is susceptible of embodiment in many different forms, there is shown in the drawings, and will herein be described in detail, four presently considered preferred embodiments of the invention, with the understanding that the present disclosure is to be considered as an exemplification of the principles of the invention and is not intended to limit the invention to the specific embodiments illustrated.

FIG. 1 illustrates a wheeled construction vehicle 10 of the type commonly referred to as a "loader/-backhoe" or "backhoe". Vehicle 10 includes a frame or chassis 14, a backhoe unit or first material handling implement 16 operatively connected to and supported on rear end 18 of frame 14 and a loader unit or second material handling implement 20 operatively connected to and supported on front end 22 of frame 14. One type of backhoe unit 16 that can be used in construction vehicle 10 is shown and described in Long U.S. Pat. No. 3,047,171 and a loader unit 20 that can be used with construction vehicle 10 is shown and described in Shumaker, U.S. Pat. No. 4,026,428.

A pair or set of front steering wheels 24 and rear driving wheels 26 accomodate movement of vehicle 10 and dynamically support frame 14 during movement of vehicle 10. Frame 14 has one side 30 and an opposed side (not shown) with front end 22 and rear end 18 extending laterally between and connecting one opposed side 30 to the other. An operator's compartment 32 is supported on frame 14 between opposed sides 30 and between rear end 18 and front end 22.

In order to provide lateral stabilization for vehicle 10 and to lift rear wheels 26 off the ground during operation of backhoe unit 16, a stabilizer assembly 34 is mounted to frame 14. Stabilizer assembly 34 includes a pair of stabilizer arms 36 and 38 which extend transversely outward from frame 14 and have stabilizer pads 40 pivotally connected to the outboard ends thereof. The inboard ends of stabilizer arms 36 and 38 are pivotally connected to frame 14 in accordance with the present invention and will, accordingly, be discussed in further detail hereinbelow. The outboard ends of stabilizer arms 36 and 38, and the pads 40 attached thereto, are raised and lowered with respect to the ground by a pair of stabilizer cylinders 42 and 44. As seen in all the figures, the respective piston rod portions 46 and 48 of cylinders 42 and 44 are respectively pivotally connected to the stabilizer arms 36 and 38 adjacent the outboard ends thereof and the hydraulic cylinder portions 50 and 52 of cylinders 42 and 44 are respectively pivotally connected to corresponding ears 54 welded to upper portions of frame 14 on either side thereof. The extension and retraction of the rod portions 46 and 48 relative to corresponding cylinder portions 50 and 52 are effective to respectively lower and raise the stabilizer pads 40 relative to the ground between ground engaging and lifting positions in contact with the ground and transport positions above the ground. In some circumstances it may be desirable to have one or more auxiliary stabilizer arms mounted adjacent front end 22 of vehicle 10.

Figure 2:
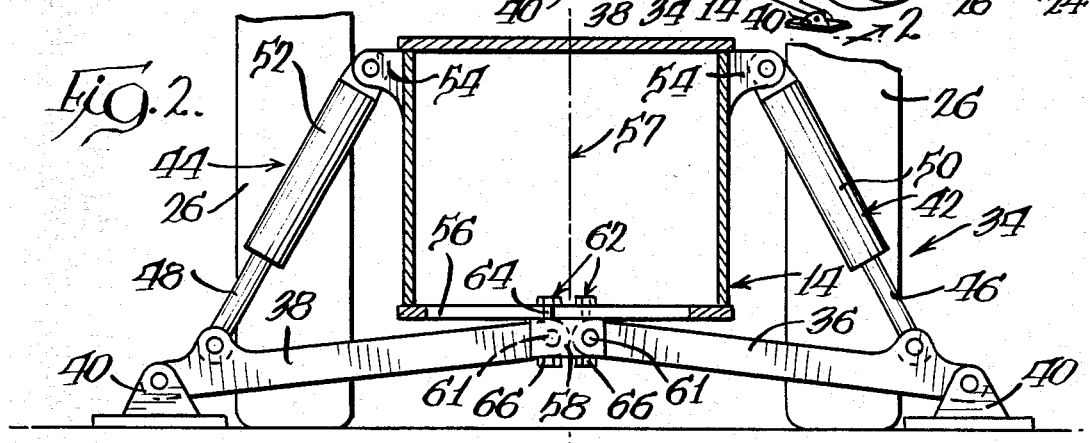
FIG. 2 is a sectional view taken along line 2—2 in FIG. 1 showing a first embodiment of the stabilizer assembly with the stabilizers in a normal lowered position in contact with the ground.
Figure 3:
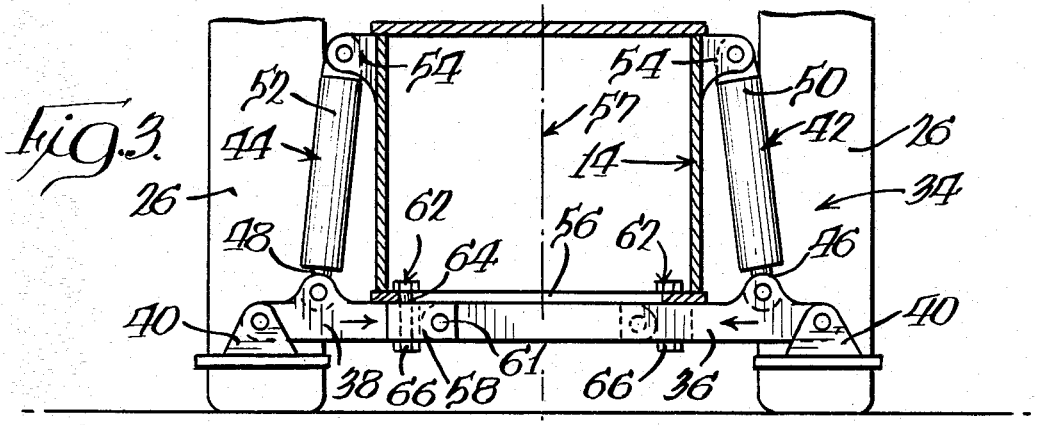
FIG. 3 is a sectional view similar to FIG. 2 showing the first embodiment of the stabilizer assembly with the stabilizers in a retracted raised position above the ground.
Figure 4:
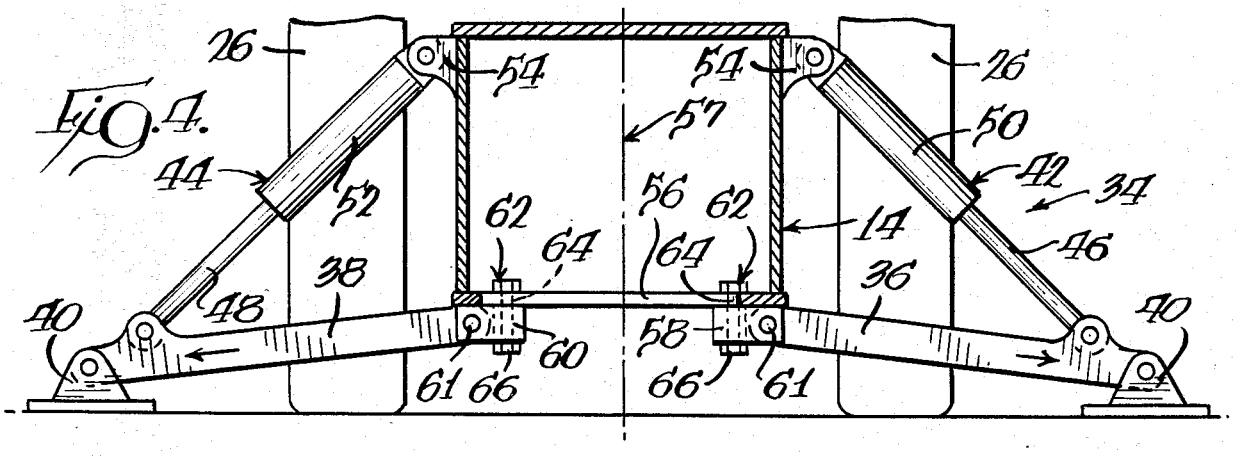
FIG. 4 is a sectional view similar to FIG. 2 showing the first embodiment of the stabilizer assembly with the stabilizers in a extended lowered position in contact with the ground.

Referring to FIGS. 2, 3 and 4, a first preferred embodiment of the stabilizer assembly incorporating the principles of the present invention is illustrated in various operating positions and indicated by the numeral 34. Stabilizer assembly 34 includes stabilizer arms 36 and 38, stabilizer cylinders 42 and 44 and stabilizer pads 40 constructed and mounted as hereinabove described. A pair of transversely extending slots 56 (only one of which is shown) are formed in a lower portion of frame 14, which extend on both sides of the longitudinal center line of the frame 14, indicated at 57. The slots 56 are longitudinally spaced a short distance apart. The inboard ends of stabilizer arms 36 and 38 are respectively pivotally connected to stabilizer anchors 58 and 60 through pins 61. Anchors 58 and 60 are mounted to frame 14 in a suitable manner by fastening means 62 which permits them to transversely slide relative to a corresponding slot 56 on either side of the center line 57. One embodiment of the fastening means 62 includes a threaded bolt 64 which extends through the slot 56 and a corresponding anchor 58 or 60 and receives a nut 66. The dimension of the body of bolt 64 is such as to permit transverse movement thereof within slot 56 when the nut 66 is loosened. The tightening of nut 66 applies a clamping pressure between the corresponding anchor 58 or 60 and the frame 14 to preclude the movement of the anchor 58 or 60 relative to the frame 14.

The operation of the stabilizer assembly 34 will now be described. Referring to FIG. 3, the stabilizer assembly 34 is shown in what is called its retracted raised position, which position is used when the stabilizer assembly is not operative, such as during transport of vehicle 10. In this position the rod portions 46 and 48 are retracted into cylinder portions 50 and 52 of the stabilizer cylinders 42 and 44 and the anchors 58 and 60 are retained in position adjacent the ends of the slots 56 on opposite sides of the center line 57. As such, the pads 40 are raised above the ground and positioned nearer to the center line 57 generally in longitudinal alignment with a corresponding wheel 26.

Under normal operating conditions of the vehicle 10 on relatively flat ground with no working obstructions present, the stabilizer assembly is moved into its normal lowered position, as shown in FIG. 2. In order to move assembly 34 from its position shown in FIG. 2 to its position shown in FIG. 3, the nuts 66 are loosened and the anchors 58 and 60 are manually slid towards center line 57, while the rod portion 46 and 48 are extended from corresponding cylinder portions 50 and 52 by operation of the valves which control the cylinders. Depending upon the geometry of the various elements of assembly 34, it may be necessary to intermittently extend the rod portions 46 and 48 and move the anchors 58 and 60 until the desired positions are reached. The nuts 66 are tightened to retain anchors 58 and 60 in place prior to operation of the vehicle 10. As will be noted from FIG. 2, the pads 40 are in contact with the ground and positioned a short distance outside of the wheels 26.

When it is necessary to operate vehicle 10 either on a hillside or near an obstruction, the stabilizer pads 40 may be selectively positioned either nearer or farther from the center line 57. Referring to FIG. 4, the stabilizer assembly 34 is shown with both of the stabilizer pads 40 in an extended position farther from the center line 57. In order to attain this position the procedure as disclosed above is utilized except that the anchors 58 and 60 are positioned adjacent the ends of slots 56 on the same side of the center line 57 as their corresponding stabilizer arm 36 or 38. When in this position maximum stability is provided to vehicle 10. When one or both sides of the vehicle 10 are required to operate adjacent an obstruction, one or both of the stabilizer pads may be retained in the position shown in FIG. 3 and the corresponding rod portions 46 and 48 are extended to move the pad 40 into contact with the ground generally in longitudinal alignment with the wheel 26. In so doing the stabilizer assembly 34 may be utilized even when the vehicle is next to an obstruction such as a building.

Figure 5:
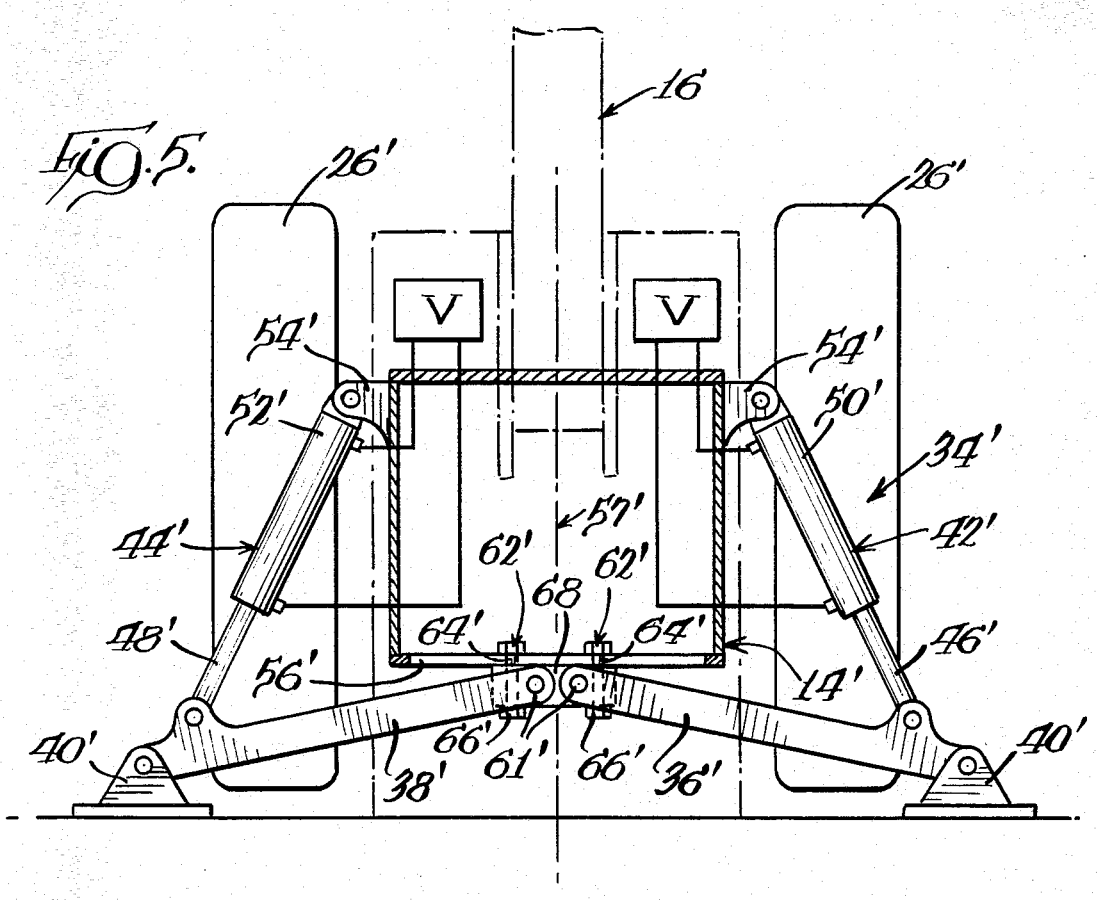
FIG. 5 is a sectional view similar to FIG. 2 showing a second embodiment of the stabilizer assembly with the stabilizers in a normal lowered lifting position in contact with the ground, with the wheels raised above the ground.
Figure 6:
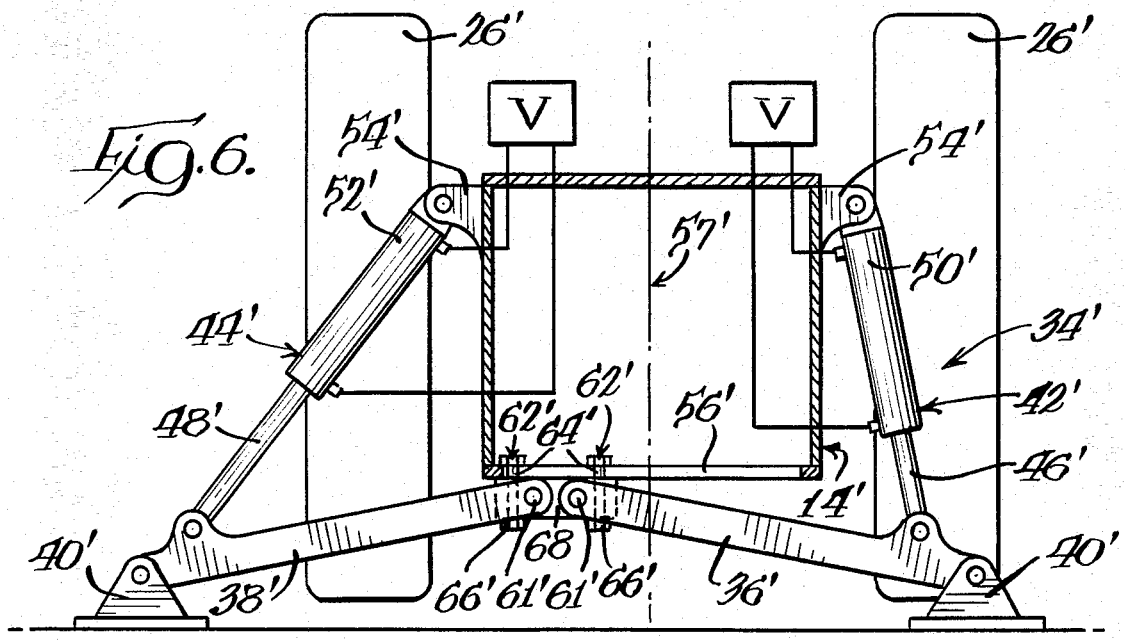
FIG. 6 is a sectional view similar to FIG. 5 showing the second embodiment of the stabilizer assembly with one of the stabilizers in a lowered extended position in contact with the ground and the other stabilizer in a lowered retracted position in contact with the ground, with the wheels raised above the ground.

Referring now to FIGS. 5 and 6, a second preferred embodiment of a stabilizer assembly incorporating the principles of the present invention is illustrated in two operating positions and identified by the numeral 34'. The structural elements of the second embodiment 34', which are common to the first embodiment, are identified by the same reference numeral followed by a single prime sign and the hereinabove discussion relative to these common elements will not be repeated. In this embodiment, the inboard ends of stabilizer arms 36' and 38' are pivotally mounted to a common stabilizer anchor 68 which is slidably movable relative to a single slot 56' formed in frame 14', in a similar manner as in the first embodiment, by a pair of fastener assemblies 62'.

Referring to FIG. 5, the material handling implement 16 is shown schematically in phantom lines in contact with the ground. The stabilizer assembly 34' is in its normal lowered position with the wheels raised above the ground by the stabilizer assembly 34'. In accordance with this embodiment, since there is a common anchor 68 for both pads 40', the pads 40' move in the same direction, one towards the center line 57' and the other way from the center line 57'. Referring to FIG. 6, the stabilizer assembly 34' is in a position with one of the pads 40' in an extended position and the other pad 40' in a retracted position.

The method of operation of the stabilizer assembly 34' will now be described. In contrast to the operation of the stabilizer assembly 34, wherein the vehicle wheels 26' are on the ground and the anchors move relative to the ground, in the operation of stabilizer assembly 34' the vehicle wheels 26' are raised off the ground by the stabilizer assembly 34' and the rear end of the vehicle frame 14' is moved relative to the ground. More specifically, with the stabilizer assembly 34' positioned as in FIG. 5, the nuts 66' are loosened and the rear end of the vehicle frame 14' is transversely moved relative to the anchor 68. In cooperation with the movement of the frame 14', it is necessary to extend the piston portion 48' and retract the piston portion 46', by use of control valves V, to prevent the vehicle 10 from tipping too far from its level position. As the rear end of the frame 14' moves relative to the ground the anchor 68 slides within slot 56' towards one end thereof. In accordance with one aspect of the invention the material handling implement 16', i.e. the backhoe, is utilized to so move the frame 14' by urging the backhoe into contact with the ground in a manner which creates a resultant force to transversely move the rear end of the frame 14' in the desired direction. Upon orienting the stabilizer assembly 34' into its desired position, the nuts 66 are tightened and the wheels 26' may be lowered to the ground by operation of the stabilizer cylinders 42 and 44.

Figure 7:
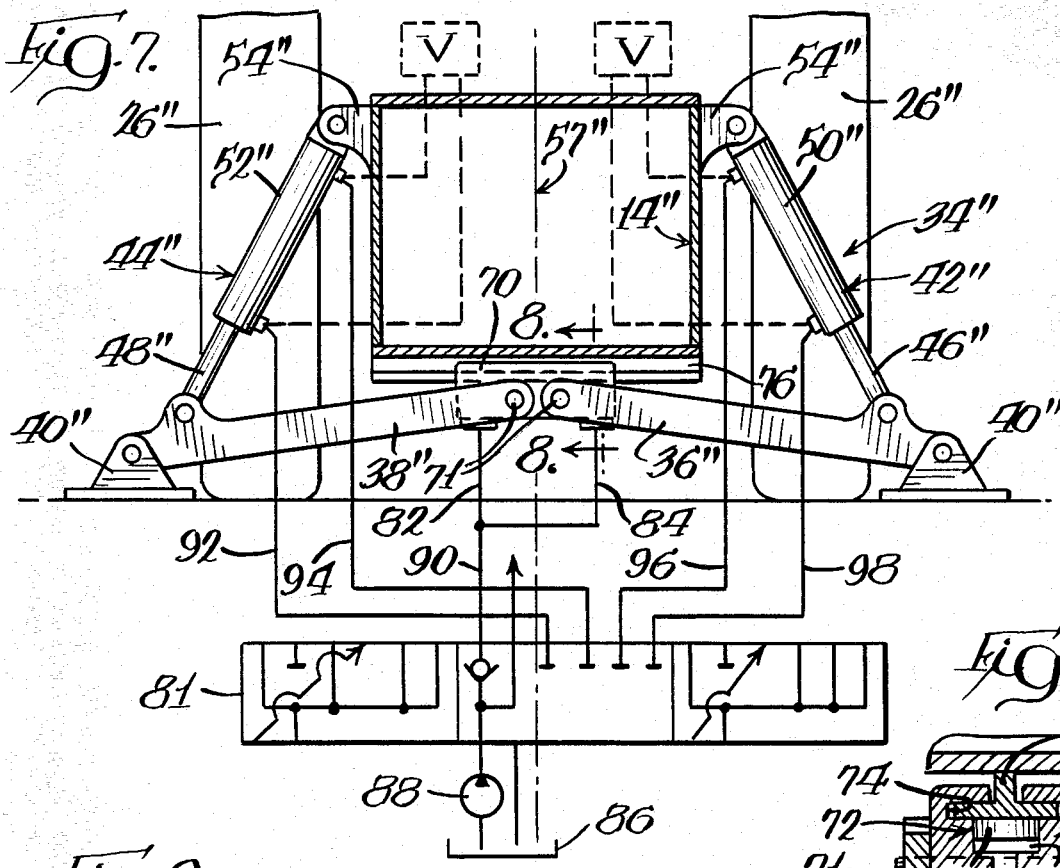
FIG. 7 is a sectional view similar to FIG. 2 showing a third embodiment of the stabilizer assembly with the stabilizers in a normal lowered position in contact with the ground, and a schematic representation of a hydraulic control circuit in its neutral position.
Figure 8:
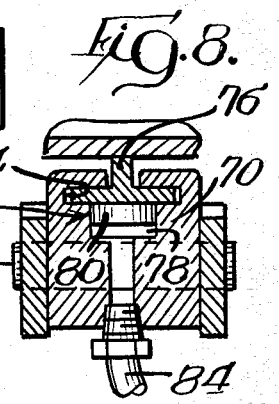
FIG. 8 is a sectional view taken along line 8—8 in FIG. 7 showing the details of a hydraulic piston clamp.
Figure 9:
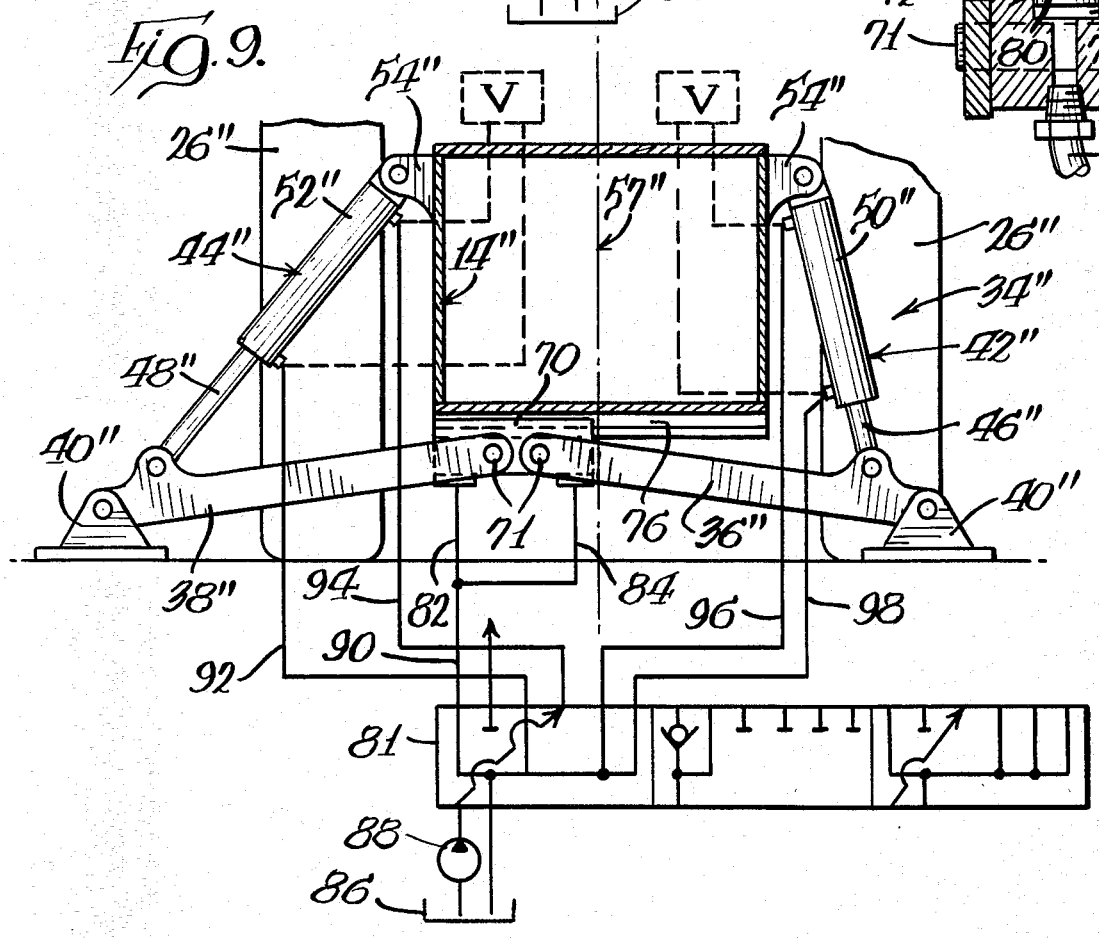
FIG. 9 is a sectional view similar to FIG. 7 showing a third embodiment of the stabilizer assembly with one of the stabilizers in a lowered extended position in contact with the ground and the other stabilizer in a lowered retracted position in contact with the ground, and a schematic representation of the hydraulic control circuit in its operative position.

Referring now to FIGS. 7, 8 and 9, a third preferred embodiment of a stabilizer assembly incorporating the principles of the present invention is illustrated in two operating positions and is identified by the numeral 34''.

The structural elements of the third embodiment 34", which are common to the first and second embodiments, are identified by the same reference numeral followed by a double prime sign and the hereinabove discussion relative to these common elements will not be repeated. In this embodiment, the inboard ends of stabilizer arms 36" and 38" are pivotally mounted to a common stabilizer anchor 70, by pins 71, which is in turn slidably mounted to the frame 14". This embodiment hydraulically positions the stabilizer arms 36" and 38" by use of the stabilizer cylinders 42" and 44" and hydraulically clamps the anchor 70 to the frame 14" by use of piston clamps 72.

As best seen in FIG. 8, anchor 70 is formed with a transversely extending T-shaped recess 74 in facing relationship to the underside of frame 14". The underside of frame 14" is provided with a transversely extending T-shaped rail 76 which is slidably received in recess 74. A pair of cylinder chambers 78, only one of which is shown, having hydraulic pistons 80 positioned therein, are provided in anchor 70 in direct communication with recess 74. The lower ends of the chambers 78 are in communication with a source of pressurized hydraulic fluid, in a manner well known in the art. The pistons 80 are movable within the chamber 78 between a raised or clamping position in contact with the rail 76 upon the pressurization of the chambers 78 and a lowered or released position upon the release of pressure from the chambers 78. In essence the pistons 80 serve as a means to selectively brake or lock the anchor 70 in a fixed position relative to the frame 14".

Referring to FIGS. 7 and 9, a schematic representation of a hydraulic control system is shown to operate the piston clamps 72 and the stabilizer cylinders 42" and 44". The control system includes a three position valve spool 81. Valve spool 81 has a central position, shown in FIG. 7, wherein the conduits 82 and 84 leading to the respective chambers 78 are in communication with the pressurized fluid from tank 86 through pump 88 and conduit 90 and the respective conduits 92, 94, 96 and 98 of the stabilizer cylinders 42" and 44" are closed off to maintain the fluid pressure in the cylinders. With the valve spool 81 in this position, the chambers 78 are pressurized urging the pistons 80 into contact with rail 76 and thus retaining anchor 70 in a fixed position relative to frame 14". The other two positions of the valve spool 81 will be discussed immediately hereinbelow.

The operation of the stabilizer assembly 34" will now be discussed. Referring to FIG. 7, the vehicle wheels 26" are in contact with the ground and the stabilizer assembly 34" is shown in a normal lowered position in contact with the ground. When in this position the anchor 70 is centrally disposed on rail 76 through the center line 57" of the frame 14". Further, the valve spool 81 is in its central position which, as discussed above, maintains the anchor 70 rigidly affixed to rail 76 and the stabilizer cylinders 42" and 44" in a fixed relationship. The control valves V, and a conventional hydraulic circuit associated therewith, are utilized to raise and lower the outboard ends of stabilizer arms 36" and 38" to raise and lower the pads 40" between their transport positions and their operative positions.

As was the case with the stabilizer assembly 34', under certain operating conditions it is desirable to reposition the anchor 70 on one side or the other of center line 57" so as to move one of the pads 40" nearer to its corresponding wheel 26" and the other pad 40" farther from its corresponding wheel 26", as so seen in FIG. 9. In order to so reposition the various elements of stabilizer assembly 34", the valve spool 81 is shifted to the right into one of its operating positions. By so doing, the fluid pressure in conduits 82, 84, and 90 is relieved to the reservoir 86 which relieves the fluid pressure in the chambers 78 causing the pistons 80 to withdraw from contact with rail 76. This permits the anchor 70 to transversely slide on rail 76 relative to the center line 57". With the valve spool 81 so positioned, the fluid pressure in the conduits 96 and 98 is relieved to the reservoir 86, relieving the pressure in stabilizer cylinder 42", and permitting rod portion 46" to freely extend and retract relative to cylinder portion 50". Also, the fluid pressure in conduit 92 is relieved to reservoir 86 relieving the fluid pressure on the rod end of stabilizer cylinder 44" and the conduit 94 is moved into communication with pump 88 which maintains fluid pressure on the cylinder end of stabilizer cylinder 44". Accordingly, the rod portion 48" is caused to extend from cylinder portion 52" which results in a force with a horizontal component sufficient to slide anchor 70 to the left and simultaneously move the outboard end of stabilizer arm 38", and the pad 40" attached thereto, farther from the center line 57". At the same time the rod portion 46" is caused to retract into cylinder 50" and the outboard end of stabilizer arm 36", and the pad 40" attached thereto, are moved nearer to the center line 57". At such time as the elements are positioned as desired, the valve spool 81 is moved back in its central position which activates piston clamps 72 to retain anchor 70 in a fixed position. As will be apparent from the control circuit schematic, the other position on the valve spool 81 is utilized to move the anchor 70 to the other side of the center line 57" in the same manner as immediately hereinabove discussed.

Figure 10:
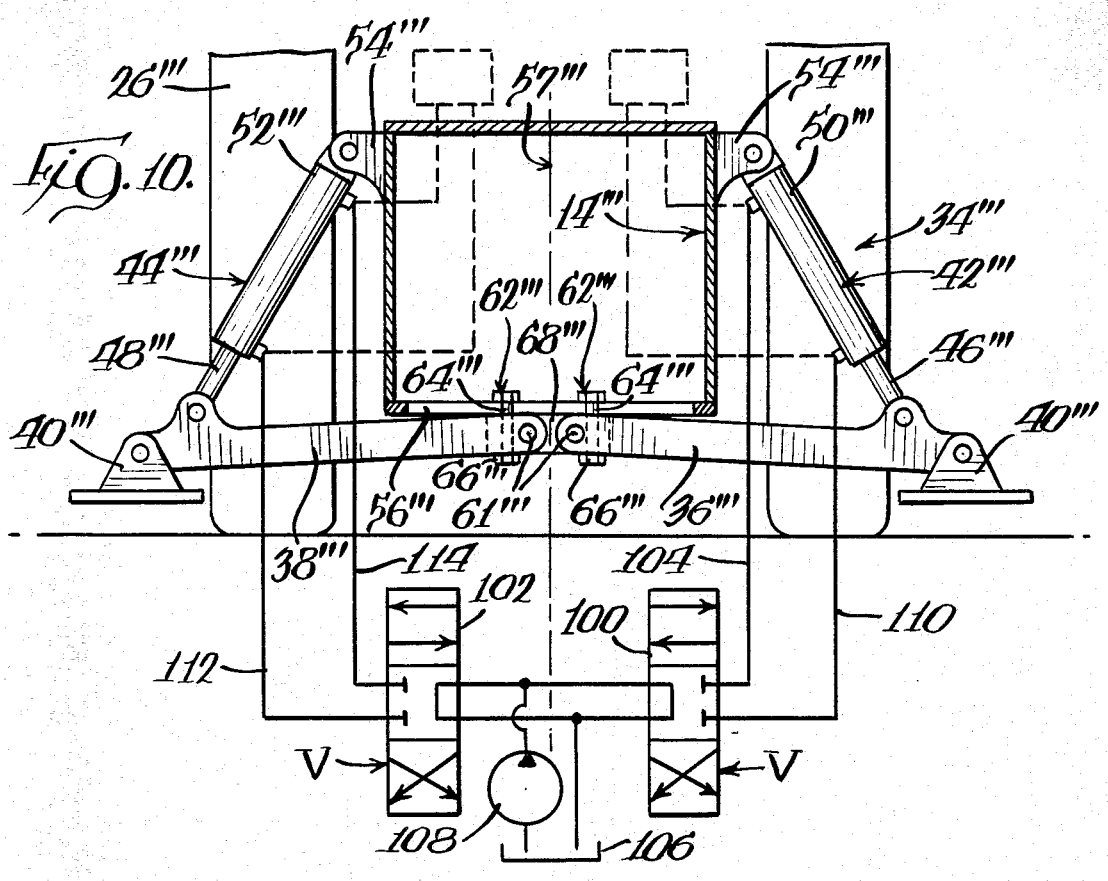
FIG. 10 is a sectional view similar to FIG. 2 showing a fourth preferred embodiment of the $tabilizer assembly with the stabilizers in a raised normal position above the ground, and a schematic representation of a hydraulic control circuit in its neutral position.
Figure 11:
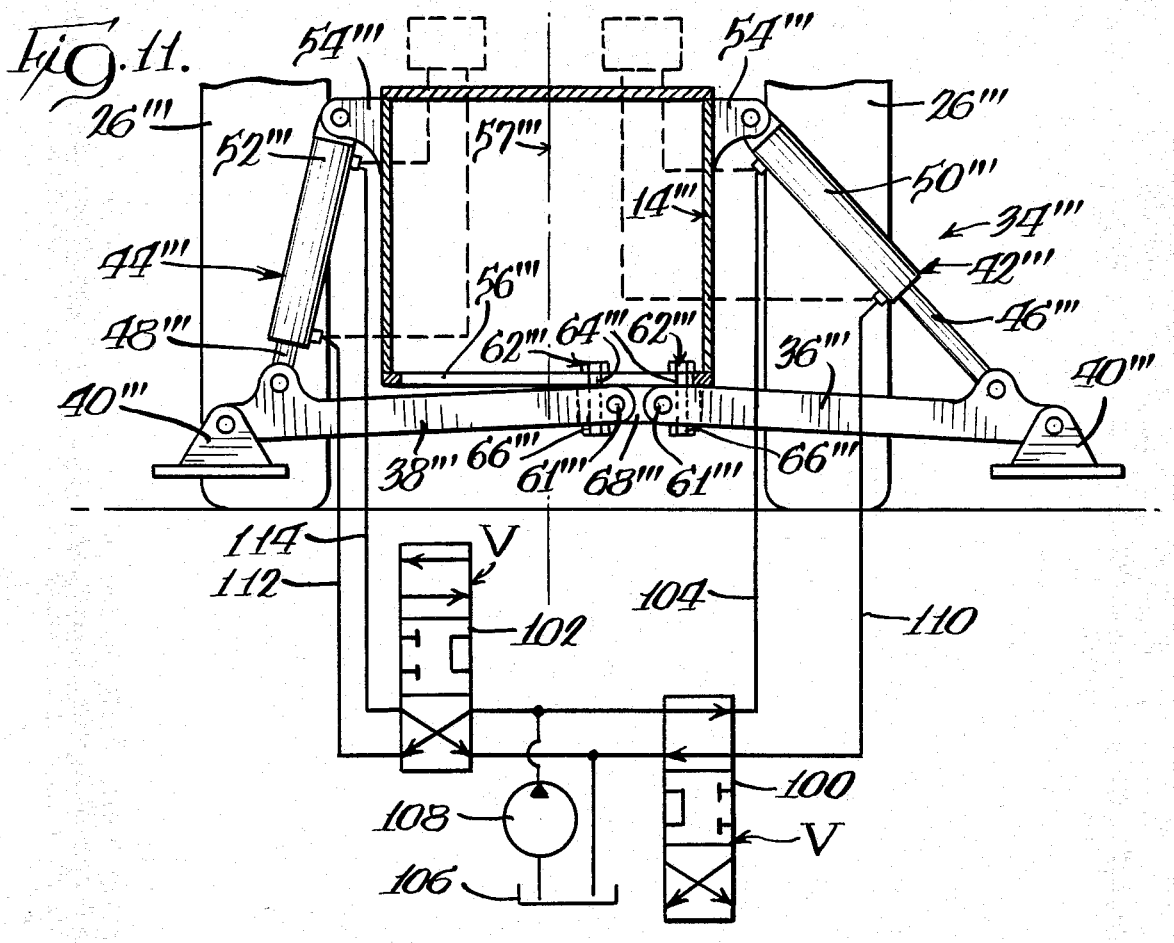
FIG. 11 is a sectional view similar to FIG. 10 showing the fourth preferred embodiment of the stabilizer assembly with one of the stabilizers in a raised extended position above the ground and the other stabilizer in a raised retracted position above the ground, and a schematic representation of the hydraulic control circuit in its operative position.

Referring now to FIGS. 10 and 11, a fourth preferred embodiment of the stabilizer assembly incorporating the principles of the present invention is illustrated in two operating positions and is identified by the numeral 34'''. The structural elements of the fourth embodiment 34''', which are common to the other embodiments, are identified by the same reference numeral followed by a triple prime sign and the hereinabove discussion relative to these common elements will not be repeated. In this embodiment, the construction of stabilizer assembly 34''' is substantially the same as disclosed with regards to the stabilizer assembly 34', as shown in FIGS. 5 and 6. Although not discussed with regards to the other embodiments, the hydraulic control valve circuit which is shown in FIGS. 10 and 11 is typical of the control valve circuit V which may be used to control the stabilizer cylinders in all of the embodiments and will now be briefly discussed in regards to the operation of stabilizer assembly 34'''. The control valve circuit V includes a pair of valve spools 100 and 102 which respectively control the operation of the stabilizer cylinders 42''' and 44'''. The valve spools 100 and 102 each have three positions; one position provides fluid pressure to the rod end of the cylinder portions 50''' or 52''' while relieving the pressure from the other end, another position relieves fluid pressure from the rod end of the cylinder portions 50''' or 52''' while providing pressure to the other end; and the third position is a neutral position which maintains the pressure in both ends of the cylinder portions 50''' or 52'''. It can thus be seen that by control of the valve spools 100 and 102 the extension and retraction of the rod portions 46''' and 48''' relative to the corresponding cylinder portions 50''' and 52''' can be selectively controlled. This control arrangement is contemplated for use in any of the embodiments of the invention disclosed herein to raise and lower the outboard ends of the stabilizer arms, and the stabilizer pads attached thereto, relative to the ground.

Although the stabilizer assembly 34''' is of similar construction to stabilizer assembly 34' the method of operation of same is quite different. With regards to assembly 34' the wheels 26' are raised off ground and the frame 14' is transversely moved relative to the ground, while in assembly 34''' the wheels 26''' remain on the ground and the anchor 68''' is transversely moved relative to the ground. Referring to FIG. 10, the stabilizer assembly 34''' is shown in its normal raised position and the valve spools 100 and 102 are in their neutral positions. As with the other embodiments, under certain operating conditions it is desirable to move stabilizer assembly 34''' to the position shown in FIG. 11. This is accomplished by loosening nuts 66''' to permit anchor 68''' to transversely move in slot 56'''. The valve spool 100 is moved into the position wherein the cylinder end of cylinder portion 50''' is pressurized through conduit 104 with fluid from reservoir 106 and pump 108 while the rod end of cylinder portion 50''' is relieved of fluid through conduit 110, which is effective to extend rod portion 46''' from cylinder portion 50'''. At the same time, the valve spool 102 is moved into the position wherein the rod end of cylinder portion 52''' is pressurized through conduit 112 with fluid from reservoir 106 and pump 108 while the cylinder end of cylinder portion 52''' is relieved of fluid through conduit 114, which is effective to retract rod portion 48''' into cylinder portion 52'''. The net result of such movement of the stabilizer cylinders 42''' and 44''' is to urge the anchor 68''' to the right and thereby move the outboard end of stabilizer arm 36''' farther from the center line 57''' and move the outboard end of stabilizer arm 38''' nearer to the center line 57'''. During such movement of the stabilizer cylinder 42''' it may be necessary for the operator to periodically meter the fluid flow through conduit 110 to prevent the pad 40''' from touching the ground by manipulation of valve spool 100. Upon reaching the desired position, the valve spools 100 and 102 are moved into their neutral positions and the nuts 66''' are tightened. The valve spools may then be appropriately positioned to extend the rod portions 46''' and 48''' and thereby move the pads 40''' into contact with the ground.

It will be understood that various departures from the specifically disclosed embodiments of the invention may be effected without departing from the principles of the invention. For example, various alternative clamping means may be employed to selectively retain the stabilizer anchor in a fixed relationship to the vehicle frame and alternative arrangement may be utilized to effect the sliding connection of the stabilizer anchor to the vehicle frame. Further, it will be understood that the invention is not strictly limited in its application to a backhoe type of vehicle, but is similarly applicable to other types of mobile equipment wherein similar problems are encountered as, for example, in boom cranes, power shovels, and the like. It is intended that the appended claims cover all such modifications as fall within the true spirit and scope of the invention.

What is claimed is:

1. In a mobile heavy vehicle having a frame with a load lifting boom, an improved stabilizer assembly having a pair of stabilizers positioned one on each side of the vehicle to provide stabilization against tipping of the vehicle comprising: an anchor for stabilizing each of said stabilizers, means mounting each of said anchors to a lower portion of said frame so as to permit selective transverse positioning thereof on either side of the longitudinal center line of the vehicle including cooperating slot means defined by said frame and retaining means for positively positioning each anchor relative to the frame in a preselected position on either side of said longitudinal center line; first and second stabilizer legs having inboard ends which are pivotally secured to its respective stabilizer anchor and outboard ends which are respectively pivotally secured to first and second stabilizer pads; first and second stabilizer cylinders having first ends which are pivotally secured to upper portions of said frame, one on each side of said longitudinal center line, and second ends which are respectively pivotally secured to said first and second stabilizer legs for selectively moving the outboard ends of said stabilizer legs between raised and lowered positions, wherein said transverse positioning of said stabilizer anchors permits positioning of said first and second stabilizer pads between a retracted position nearer said longitudinal center line and an extended position farther from said longitudinal center line.

2. The invention as defined in claim 1 wherein each said retaining means comprises a threaded fastener which extends through each said stabilizer anchor and each said transverse slot means.

3. The invention as defined in claim 1 further including hydraulic means for positioning each said stabilizer anchor on either side of said longitudinal center line.

4. In a mobile heavy vehicle having a frame with a load lifting boom, an improved stabilizer assembly having a pair of stabilizers positioned one on each side of the vehicle to provide stabilization against tipping of the vehicle; comprising: a stabilizer anchor slidably mounted on a transverse rail member secured to a lower portion of said frame so as to permit selective transverse positioning thereof on either side of the longitudinal center line of the vehicle; first and second stabilizer legs having inboard ends which are pivotally secured to said stabilizer anchor and outboard ends which are respectively pivotally secured to first and second stabilizer pads; first and second stabilizer cylinders having first ends which are pivotally secured to upper portions of said frame, one on each side of said longitudinal center line, and second ends which are respectively pivotally secured to said first and second stabilizer legs for selectively moving the outboard ends of said stabilizer legs between raised and lowered positions; and retaining means including a hydraulic clamp means including a clamp piston associated with said stabilizer anchor for clamping the stabilizer anchor to said rail member for selectively retaining said stabilizer anchor in a preselected position on either side of said longitudinal center line, wherein said transverse positioning of said stabilizer anchor permits positioning of said first and second stabilizer pads between a retracted position nearer said longitudinal center line and an extended position farther from said longitudinal center line.

* * * * *